US010490984B1

(12) United States Patent
Ichihara

(10) Patent No.: US 10,490,984 B1
(45) Date of Patent: Nov. 26, 2019

(54) METHOD OF PRODUCING COMPOSITE FOR FORMING ELECTRODE OF IGNITION PLUG AND METHOD OF PRODUCING IGNITION PLUG

(71) Applicant: NGK SPARK PLUG CO., LTD., Nagoya-shi, Aichi (JP)

(72) Inventor: Hiroshi Ichihara, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/417,783

(22) Filed: May 21, 2019

(30) Foreign Application Priority Data

Jun. 6, 2018 (JP) ..... 2018-108257

(51) Int. Cl.

| | |
|---|---|
| ***H01T 21/02*** | (2006.01) |
| ***H01T 21/06*** | (2006.01) |
| ***H01T 13/34*** | (2006.01) |
| ***H01T 13/32*** | (2006.01) |

(52) U.S. Cl.
CPC ..... *H01T 21/02* (2013.01); *H01T 13/32* (2013.01); *H01T 13/34* (2013.01); *H01T 21/06* (2013.01)

(58) Field of Classification Search
CPC ..... H01T 21/02; H01T 21/06; H01T 13/32; H01T 13/34
See application file for complete search history.

(56) References Cited

U.S. PATENT DOCUMENTS

2002/0073539 A1* 6/2002 Hori ..... H01R 43/0214 29/857
2011/0193471 A1* 8/2011 Kato ..... H01T 13/20 313/141
2013/0157538 A1 6/2013 Ichihara et al.

FOREIGN PATENT DOCUMENTS

JP WO2012/039381 A1 3/2012

* cited by examiner

*Primary Examiner* — Anne M Hines
(74) *Attorney, Agent, or Firm* — Kusner & Jaffe

(57) ABSTRACT

A first member and a second member are held by being sandwiched by first and second holders. By providing force, which brings N nails (N is an integer that is 2 or greater) of chucks closer to each other, to the N nails, each of L nails contacts the first member without contacting the second member and each of M nails contacts the second member without contacting the first member. By separating the second holder from the second member, the N nails get even closer to each other, and the second member is moved relative to the first member, then a relative position of the first and second members is adjusted. By making the second holder contact with the second member again, the first and second members are held. After removing the chucks from the first and second members, a contact portion of the first and second members is laser-welded.

10 Claims, 7 Drawing Sheets

METHOD OF PRODUCING COMPOSITE FOR FORMING ELECTRODE OF IGNITION PLUG AND METHOD OF PRODUCING IGNITION PLUG

BACKGROUND OF THE INVENTION

The present invention relates to a composite for forming an electrode of an ignition plug (a spark plug).

An ignition plug (a spark plug) has been used for ignition of a device (e.g. an internal combustion engine) to burn fuel. As the ignition plug, a plug having electrodes (e.g. a center electrode and a ground electrode) forming a discharge gap is used. As such electrodes, an electrode formed by a composite having a first member and a second member that is joined to the first member could be used. For instance, the center electrode is formed by a composite having a rod-shaped metal member and a tip made of noble metal etc. and joined to an end portion of the metal member. And, the ground electrode has a rod-shaped metal member and a tip joined to an end portion of the metal member, and the tip of this ground electrode is formed by a composite having a supporting member made of alloy etc. having nickel and a tip made of noble metal etc. and joined to the supporting member. To form a proper electrode, it is preferable that when two members of the composite are joined, a relative position of the two members be a proper position. As a technique of joining the two members at a proper position, for instance, International Publication WO2012039381 discloses that a first tip is held by a chuck, an eccentric error of a center axis of the first tip is detected by image processing, and when the eccentric error falls outside a tolerance range, a position of the first tip is corrected, then a second tip is laser-welded to this position-corrected first tip.

SUMMARY OF THE INVENTION

An individual difference in condition of a surface of the member such as the tip could arise, namely that the surface of the member could get dirty or the member could have a flaw on its surface. If the technique disclosed in WO2012039381 is applied to such tip, a result of the image processing might be improper due to the individual difference. For instance, the center axis of the tip identified by the image processing might considerably deviate from an actual center axis due to such improper image processing result, then there is a possibility that the first member and the second member of the composite will not be able to be joined at the proper relative position.

The present invention was made in view of the above technical problem. An object of the present invention is therefore to provide a technique of joining the first member and the second member of the composite for forming the electrode of the ignition plug at the proper relative position.

According to one aspect of the present invention, a method of producing a composite for forming an electrode of an ignition plug, the composite having a first member and a second member joined to the first member, the method comprises: a first holding step of, by a first holder and a second holder set at separate positions in a first direction, by sandwiching the first member and the second member arranged in the first direction, holding the first member and the second member with the first and second members being in contact with each other; a contacting step of, by providing N nails, where N is an integer that is 2 or greater, of chucks that are arranged at separate positions so as to surround a contact portion of the first and second members with a force that brings the N nails closer to each other in a state in which the first member and the second member are held by the first holder and second holders, making each of L nails, where L is an integer that is equal to or greater than 1 and equal to or less than N−1, of the N nails contact with the first member without contacting the second member and making each of M nails, where M is an integer that is equal to or greater than 1 and equal to or less than N−L, contact with the second member without contacting the first member, wherein the M nails are different from the L nails; a moving step of, by separating the second holder from the second member in a state in which each of the L nails contacts the first member and each of the M nails contacts the second member, bringing the N nails even closer to each other, moving the second member relative to the first member in a direction crossing the first direction and adjusting a relative position of the first member and the second member; a second holding step of, by making the second holder contact with the second member again in a state in which the relative position of the first member and the second member is adjusted, holding the first member and the second member, which have been located at the adjusted relative position, with the first and second members being in contact with each other; a removing step of removing the chucks from the first member and the second member in a state in which the first member and the second member are held; and a welding step of, after removing the chucks, laser-welding the contact portion of the first and second members in a state in which the first member and the second member are held.

According to the above method, since each of the L nails contacts the first member and each of the M nails contacts the second member in the state in which the first member and the second member are held by the first holder and second holders, a large shift or a considerable change of the relative position of the first member and the second member, which is caused by the contact with the nails, can be suppressed. Further, the second holder is separated from the second member in the state in which each of the L nails contacts the first member and each of the M nails contacts the second member. With this operation, the N nails get even closer to each other, and the second member is moved relative to the first member in the direction crossing the first direction. As a result, the relative position of the first member and the second member can be properly adjusted. Furthermore, by making the second holder contact with the second member again, the first member and the second member, which have been located at the adjusted relative position, are held with the first and second members being in contact with each other. Then, in this state, the chucks is removed, and the contact portion of the first and second members is laser-welded. Hence, it is possible to join the first member and the second member at the proper relative position.

In the above method, each of the N nails has a first portion formed so as to contact the first member in the moving step, a second portion formed so as to contact the second member in the moving step and a third portion formed so as to contact the first holder in the moving step, and in the moving step, by separating the second holder from the second member, the N nails are brought even closer to each other, and the first member is moved relative to the first holder in the direction crossing the first direction and a relative position of the first holder and the first member is adjusted.

According to the above method, since a relative position between the first holder, the first holder and the first member is properly adjusted by the N nails, the laser-welding can be performed to the first member, having been located at the proper relative position with respect to the first holder, and the second member. A proper welding can therefore be carried out.

In the above methods, in the contacting step, a sandwiching force by the first holder and the second holder is set to be greater than the force that brings the N nails of the chucks closer to each other.

According to the above method, since either one or both of the first member and the second member is prevented from moving by the force received from the nail in the contacting step, it is possible to properly adjust the relative position of the first member and the second member in the moving step.

In the above methods, the number of the nails is three or greater.

According to the above method, it is possible to properly adjust the relative position of the first member and the second member.

In the above methods, each of the N nails has one or more holding portions including a portion formed so as to contact the first member and a portion formed so as to contact the second member in the moving step, in the moving step, a plurality of holding portions of the N nails are arranged at separate positions so as to surround the contact portion of the first and second members, and the total number of the plurality of holding portions of the N nails is three or greater.

According to the above method, it is possible to properly adjust the relative position of the first member and the second member.

According to another aspect of the present invention, a method of producing an ignition plug, the ignition plug having a tubular insulator having a penetration hole that extends in a direction of a center axis, a center electrode, at least a part of which is inserted into a top end side of the penetration hole, a tubular metal shell secured to an outer peripheral side of the insulator and a ground electrode connected to the metal shell, and at least one of the center electrode and the ground electrode being provided with a composite having a first member and a second member joined to the first member, the method comprises: producing the composite using the method by any one of the preceding claims 1 to 5; and producing the ignition plug using the produced composite.

The technique disclosed in the following can be applied to a variety of aspects. For instance, it can be applied to a composite for forming an electrode of an ignition plug, a producing method of the composite, an electrode having the composite, a producing method of the electrode, an ignition plug having the electrode, a producing method of the ignition plug, an ignition device using the ignition plug, an internal combustion engine mounting therein the ignition plug, and an internal combustion engine mounting therein the ignition device using the ignition plug.

The other objects and features of this invention will become understood from the following description with reference to the accompanying drawings.

DETAILED DESCRIPTION OF THE INVENTION

[Configuration of Ignition Plug]

Figure 1:
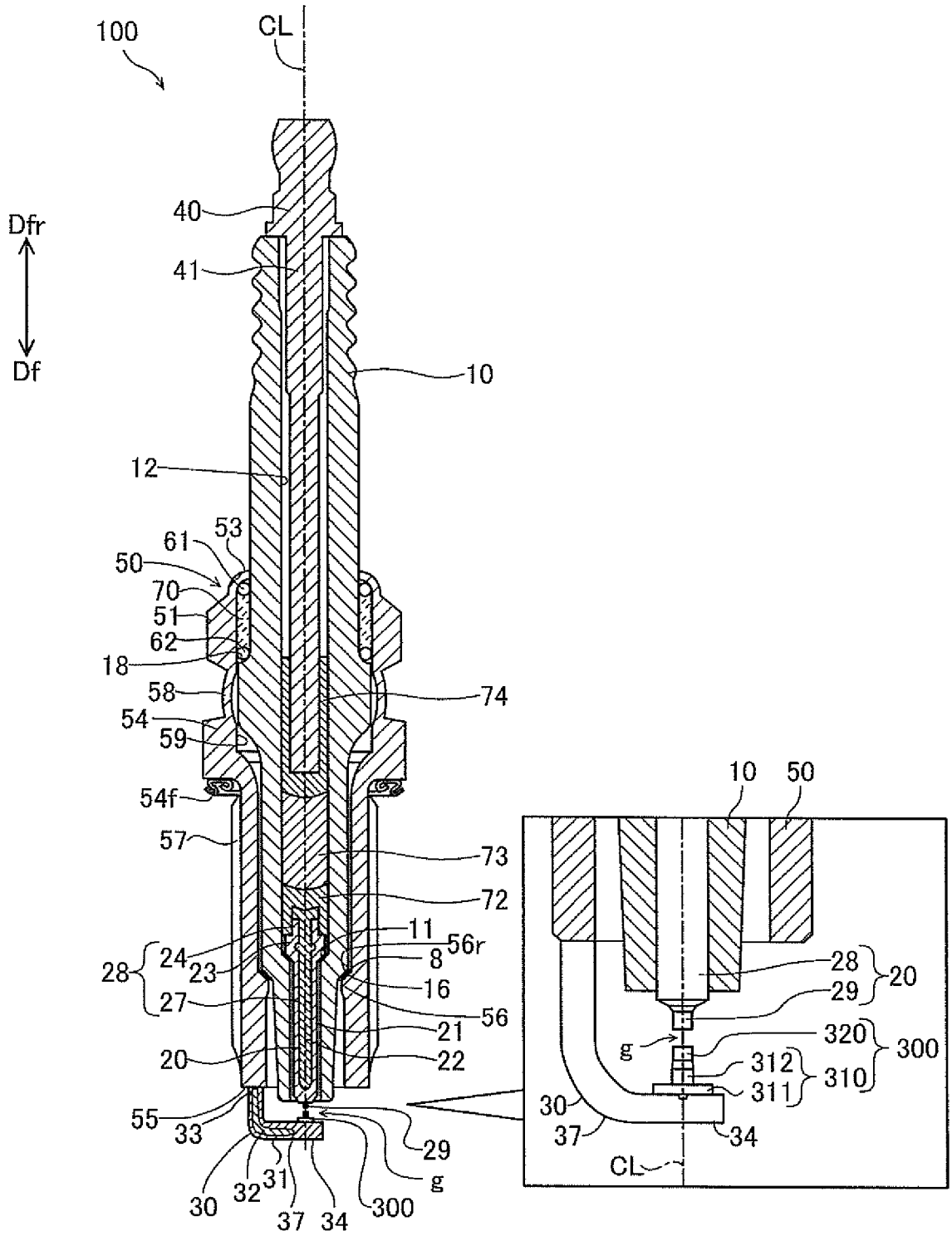
FIG. 1 is a sectional view of an ignition plug (a spark plug) 100 according to an embodiment of the present invention.

FIG. 1 is a sectional view of an ignition plug (a spark plug) 100 according to an embodiment of the present invention. In FIG. 1, a center axis (a center line) CL (also simply called an axis CL) of the ignition plug 100 and a flat cross section of the ignition plug 100 including the center axis CL are shown. In the following description, a direction that is parallel to the center axis CL is called a direction of the center axis CL (a center axis CL direction) or simply called an axis direction. A radial direction of a circle whose center is the center axis CL is called a radial direction. The radial direction is a direction that is perpendicular to the center axis CL. A circumferential direction of the circle whose center is the center axis CL is called a circumferential direction. A downward direction in FIG. 1 which is parallel to the center axis CL is called a top end direction Df or a front direction Df, and an upward direction in FIG. 1 which is parallel to the center axis CL is called a rear end direction Dfr or a rear direction Dfr. The top end direction Df is a direction leading from a metal terminal 40 (described later) toward a center electrode 20 (described later). A top end direction Df side in FIG. 1 is called a top end side of the ignition plug 100, and a rear end direction Dfr side in FIG. 1 is called a rear end side of the ignition plug 100.

The ignition plug 100 has a tubular insulator 10 having a penetration hole 12 (also called an axis hole 12) extending along the center axis CL, the center electrode 20 held at a top end side of the penetration hole 12, the metal terminal 40 held at a rear end side of the penetration hole 12, a resistor 73 provided between the center electrode 20 and the metal terminal 40 inside the penetration hole 12, a conductive first seal member 72 contacting the center electrode 20 and the resistor 73 and electrically connecting these center electrode 20 and resistor 73, a conductive second seal member 74 contacting the resistor 73 and the metal terminal 40 and electrically connecting these resistor 73 and metal terminal 40, a tubular metal shell 50 secured to an outer peripheral side of the insulator 10 and a ground electrode 30 whose one end is connected to a ring-shaped top end surface 55 of the metal shell 50 and whose other end is located so as to face the center electrode 20 through a gap g.

The insulator 10 has, at a front direction Df side thereof, a reduced-outside diameter portion 16 and a reduced-inside diameter portion 11. An outside diameter of the reduced-outside diameter portion 16 is gradually smaller toward the front direction Df. An inside diameter of the reduced-inside diameter portion 11 is gradually smaller toward the front direction Df. The insulator 10 further has, at a rear direction Dfr side thereof, a reduced-outside diameter portion 18. An inside diameter of the reduced-outside diameter portion 18 is gradually smaller toward the rear direction Dfr. It is preferable that the insulator 10 be formed in light of mechanical strength, thermal strength and electrical strength. For instance, the insulator 10 is formed by burning or baking alumina. However, the insulator 10 could be formed using other insulating materials.

The center electrode 20 is a metal-made member. The center electrode 20 is located at an end portion on the front direction Df side of the penetration hole 12 of the insulator 10. The center electrode 20 has a substantially cylindrical columned rod portion 28 and a first tip 29 joined (e.g. laser-welded) to a top end of the rod portion 28. The rod portion 28 has a head portion 24 located at the rear direction Dfr side and a shaft portion 27 connected to a front direction Df side of the head portion 24. The shaft portion 27 extends parallel to the center axis CL toward the front direction Df. The rod portion 28 further has, at a portion on the front direction Df side of the head portion 24, a brim portion 23 whose outside diameter is greater than that of the shaft portion 27. A surface on the front direction Df side of the brim portion 23 is supported by the reduced-inside diameter portion 11 of the insulator 10. The shaft portion 27 is joined to a portion on the front direction Df side of the brim portion 23. The first tip 29 is joined to a top end of the shaft portion 27. The first tip 29 has a substantially cylindrical columned shape whose axis is the center axis CL.

The rod portion 28 has an outer layer 21 and a core portion 22 provided at an inner peripheral side of the outer layer 21. The outer layer 21 is made of material (e.g. alloy having nickel as a main component) that is superior in resistance to oxidation to the core portion 22. Here, the main component means a component having the highest percentage content (mass percentage (wt %)). The core portion 22 is made of material (e.g. alloy etc. having pure copper or copper as a main component) whose thermal conductivity is higher than that of the outer layer 21. The first tip 29 is joined to the outer layer 21 of the rod portion 28 (e.g. by laser-welding). The first tip 29 is made of material (e.g. noble metal such as iridium (Ir) and platinum (Pt)) that is superior in durability to withstand electric discharge to the shaft portion 27. A part on the front direction Df side of the center electrode 20, including the first tip 29, is exposed to the front direction Df side from the axis hole 12 of the insulator 10. A part on the rear direction Dfr side of the center electrode 20 is located inside the axis hole 12. Instead of this, the whole center electrode 20 could be located inside the axis hole 12. Further, the core portion 22 might be omitted.

The metal terminal 40 is a rod-shaped member extending parallel to the center axis CL. The metal terminal 40 is made of conductive material (e.g. metal having iron as a main component). A rod-shaped portion 41 on the front direction Df side of the metal terminal 40 is inserted into the axis hole 12 of the insulator 10 at the rear direction Dfr side of the axis hole 12.

The resistor 73 provided inside the axis hole 12 of the insulator 10 is a member to suppress electrical noises. The resistor 73 is formed using mixture of, for instance, glass, conductive material (e.g. carbon particle) and ceramic particle. Seal members 72 and 74 are formed using mixture of conductive material (e.g. metallic particle such as copper and iron) and glass. The center electrode 20 is electrically connected to the metal terminal 40 through the first seal member 72, the resistor 73 and the second seal member 74.

The metal shell 50 is a tubular member having a penetration hole 59 extending along the center axis CL. A center axis of the metal shell 50 is the same as the center axis CL. The insulator 10 is inserted into the penetration hole 59 of the metal shell 50. The metal shell 50 is secured to the outer periphery of the insulator 10. The metal shell 50 is made of conductive material (e.g. metal such as carbon steel having iron as a main component). A part on the front direction Df side of the insulator 10 is exposed to the outside from the penetration hole 59. Further, a part on the rear direction Dfr side of the insulator 10 is exposed to the outside from the penetration hole 59.

The metal shell 50 has a tool engagement portion 51, a middle body portion 54 and a thread portion 57. The tool engagement portion 51 is a portion with which a tool such as a wrench (not shown) for the ignition plug is engaged. The middle body portion 54 is a flange portion located at the front direction Df side with respect to the tool engagement portion 51 and protruding outwards in the radial direction. The thread portion 57 is a portion located at the front direction Df side with respect to the middle body portion 54 and having a male thread to be screwed into a mounting hole of an internal combustion engine (not shown). A surface **54*f* on the front direction Df side of the middle body portion 54** is a seat surface, and serves a sealing function with a mounting portion (e.g. an engine head) where the mounting hole of the internal combustion engine is provided.

The metal shell 50 has, at a portion on the front direction Df side thereof, a bulging portion 56 bulging inwards in the radial direction. The bulging portion 56 has, at the rear direction Dfr side, a surface **56*r* (called a rear surface 56*r*), and its inside diameter is gradually smaller toward the front direction Df. A top end side packing 8 is sandwiched between the rear surface 56*r* of the bulging portion 56 and the reduced-outside diameter portion 16 of the insulator 10**.

The metal shell 50 further has, at the rear end side with respect to the tool engagement portion 51, a rear end portion 53 that is thinner than the tool engagement portion 51 and forms a rear end of the metal shell 50. In addition, between the middle body portion 54 and the tool engagement portion 51, a connecting portion 58 connecting the middle body portion 54 and the tool engagement portion 51 is formed. A thickness of the connecting portion 58 is smaller than those of the middle body portion 54 and the tool engagement portion 51. Annular ring members 61 and 62 are inserted between an inner peripheral surface from the tool engagement portion 51 to the rear end portion 53 of the metal shell 50 and an outer peripheral surface of a portion on the rear direction Dfr side of the reduced-outside diameter portion 18 of the insulator 10. Further, a space between these ring members 61 and 62 is filled with talc (talc powder) 70. In a production process of the ignition plug 100, when the rear end portion 53 is caulked by being bent in the radially inward direction, the connecting portion 58 is deformed by a force due to the caulking, then the metal shell 50 and the insulator 10 are fixed together. The talc 70 is compressed in this caulking process, and increases air tightness between the metal shell 50 and the insulator 10. And also, the packing 8 is pressed between the reduced-outside diameter portion 16 of the insulator 10 and the bulging portion 56 of the metal shell 50, and seals a gap between the metal shell 50 and the insulator 10.

The ground electrode 30 is a metal-made member. The ground electrode 30 has a main body 37 formed into a bar-shape. An end portion 33 (also called a base end portion 33) of the main body 37 is connected to the top end surface 55 of the metal shell 50 (e.g. by resistance welding). The main body 37 extends from the base end portion 33 connected to the metal shell 50 toward the top end direction Df, is bent toward the center axis CL and extends in a direction crossing the center axis CL, then leads to a top end portion 34. A composite tip 300 is joined to a surface on the rear direction Dfr side of the top end portion 34. The gap (spark gap) g is formed between the composite tip 300 of the ground electrode 30 and the first tip 29 of the center electrode 20.

The main body 37 has an outer layer 31 and an inner layer 32 provided at an inner peripheral side of the outer layer 31. The outer layer 31 is made of material (e.g. alloy having nickel as a main component) that is superior in resistance to oxidation to the inner layer 32. The inner layer 32 is made of material (e.g. alloy etc. having pure copper or copper as a main component) whose thermal conductivity is higher than that of the outer layer 31. The composite tip 300 is joined to the outer layer 31 of the main body 37. Here, the inner layer 32 might be omitted.

On a right side in FIG. 1, a part around the gap g is shown as an enlarged view. In this enlarged view, cross sections of the insulator 10 and the metal shell 50 and outward appearances of the center electrode 20 and the ground electrode 30 are illustrated. The composite tip 300 is a member formed by joining of a first member 310 and a second member 320. In the following description, the composite tip 300 is also called a first composite. The first member 310 is made of material (e.g. alloy having nickel as a main component) having excellent oxidation resistance. The second member 320 is made of material (e.g. noble metal such as iridium (Ir) and platinum (Pt)) having excellent durability to withstand electric discharge.

The first member 310 has a large diameter portion 311 and a small diameter portion 312. In a completed ignition plug 100 shown in FIG. 1, the small diameter portion 312 is joined to a portion on the rear direction Dfr side of the large diameter portion 311. Shapes of these large diameter portion 311 and small diameter portion 312 are each a substantially cylindrical columned shape whose axis is the center axis CL. A surface on the front direction Df side of the large diameter portion 311 is joined to a surface on the rear direction Dfr side of the top end portion 34 of the main body 37 (e.g. by laser-welding).

A shape of the second member 320 is a substantially cylindrical columned shape whose axis is the center axis CL. A surface on the front direction Df side of the second member 320 is welded to a surface on the rear direction Dfr side of the first member 310. The second member 320 is supported by the first member 310. In the following description, the first member 310 is also called a supporting member 310. Further, the second member 320 is also called a second tip 320. A surface on the rear direction Dfr side of the second tip 320 and a surface on the front direction Df side of the first tip 29 of the center electrode 20 form the gap (the spark gap) g.

First Embodiment

Figure 2:
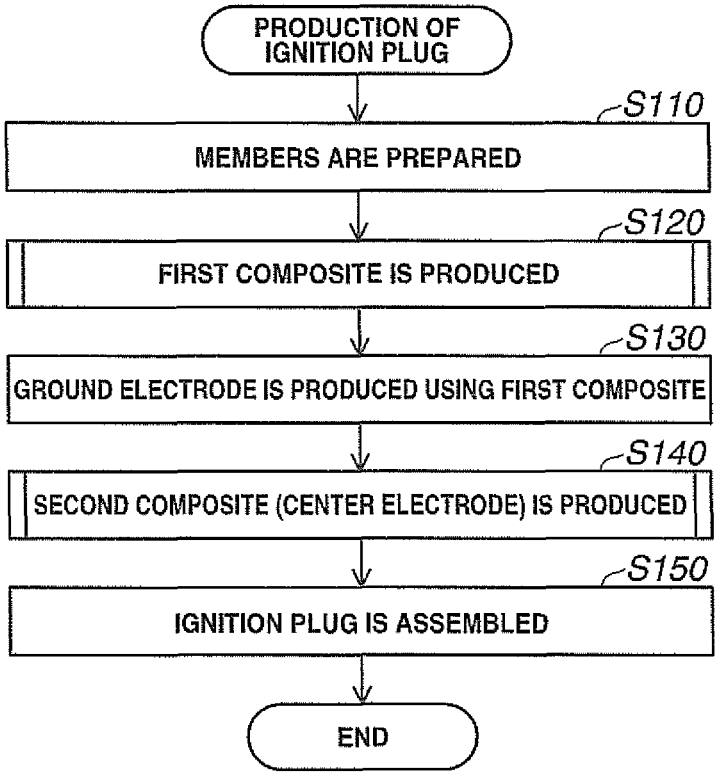
FIG. 2 is a flow chart showing an example of a method of producing the ignition plug 100.

FIG. 2 is a flow chart showing an example of a method of producing the ignition plug 100.

At step S110, members used for producing the ignition plug 100 are prepared. More specifically, as the members for the ignition plug 100, the insulator 10, the metal terminal 40, powder of material of the resistor 73, powder of material of each of the first and second seal members 72 and 74, the metal shell 50, the rod portion 28 and the first tip 29 of the center electrode 20, and the main body 37 and the supporting member 310 and the second tip 320 of the ground electrode 30 are prepared. The insulator 10 is produced, for instance, by molding powder of material such as alumina into a predetermined shape and burning or baking this molded member. Metal members such as the metal terminal 40, the metal shell 50, the rod portion 28, the first tip 29, the supporting member 310, the second tip 320 and the main body 37 are produced, for instance, by forging and cutting etc.

Figure 3:
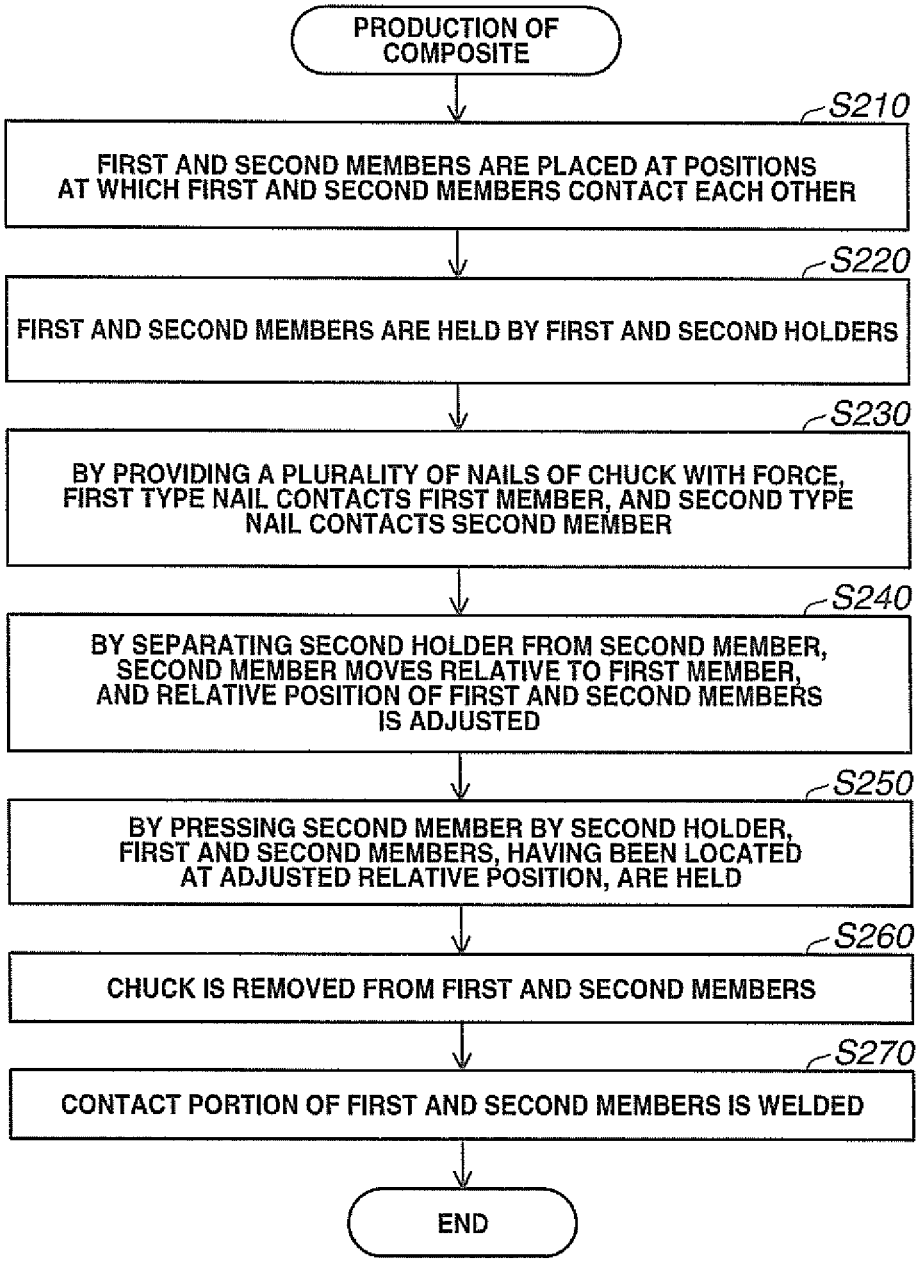
FIG. 3 is a flow chart showing an example of a method of producing a composite.

At step S120, the composite tip 300 is produced. FIG. 3 is a flow chart showing an example of a method of producing the composite. FIGS. 4A to 4D and 5A to 5C are drawings schematically showing change of a state (a position relationship) of the first member 310 (i.e. the supporting member 310) and the second member 320 (i.e. the second tip 320) in the production process of the composite tip 300. When producing the composite tip 300, the state (the position relationship) of the supporting member 310 and the second tip 320 changes in an order of FIGS. 4A to 4D and 5A to 5C. In each drawing, a first direction D1 and a second direction D2 that is an opposite direction to the first direction D1 are shown. In the present embodiment, the first direction D1 is an upward direction in a vertical axis. On a left side LP in each drawing, a schematic view viewed from a direction perpendicular to the first direction D1 (i.e. a side view) is illustrated. On a right side RP in each drawing, a schematic view viewed from the second direction D2 (i.e. a top view) is illustrated. Here, on each right side RP in the drawing, an after-mentioned second holder 520 is not illustrated. In each drawing, center axes C31 and C32 are center axes of the members 310 and 320 respectively. Production of the composite tip 300 takes place in a state in which the center axes C31 and C32 of the members 310 and 320 are substantially parallel to the first direction D1. In the present embodiment, it is assumed that the center axes C31 and C32 of the members 310 and 320 of the completed composite tip 300 are substantially fully aligned with each other.

Figure 4A:
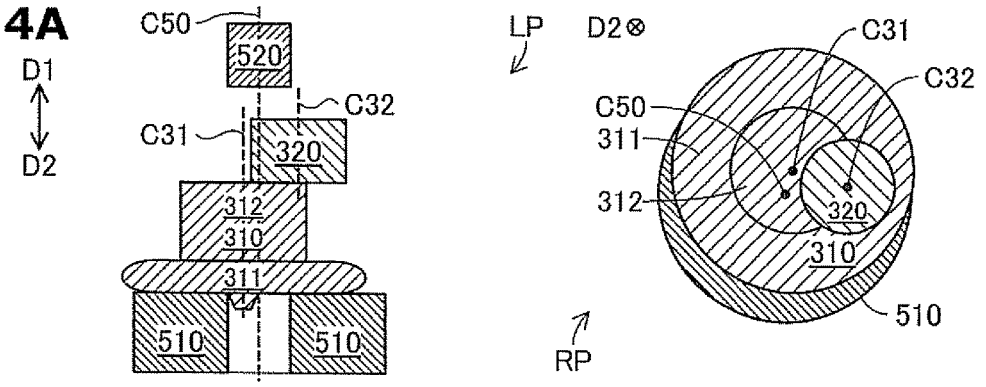
FIGS. 4A to 4D are drawings schematically showing change of a state (a position relationship) of a first member 310 and a second member 320.

At step S210 (FIG. 3), the supporting member 310 and the second tip 320 are placed at positions at which the supporting member 310 and the second tip 320 contact each other. In the present embodiment, as shown in FIG. 4A, the supporting member 310 and the second tip 320 are placed between a first holder 510 and the second holder 520. The first holder 510 is a cylindrical member whose axis is a center axis C50 that is substantially parallel to the first direction D1. The second holder 520 is a cylindrical columned member whose axis is the center axis C50. The second holder 520 is located at a first direction D1 side of the first holder 510. These first and second holders 510 and 520 are set at separate positions on the same center axis C50.

As shown in FIG. 4A, the supporting member 310 is put on a surface on the first direction D1 side of the first holder 510. The second member 320 (the second tip 320) is put on a surface on the first direction D1 side of the supporting member 310. In this stage, the center axis C50 of the first and second holders 510 and 520, the center axis C31 of the supporting member 310 and the center axis C32 of the second tip 320 may not be aligned with each other.

Figure 4B:
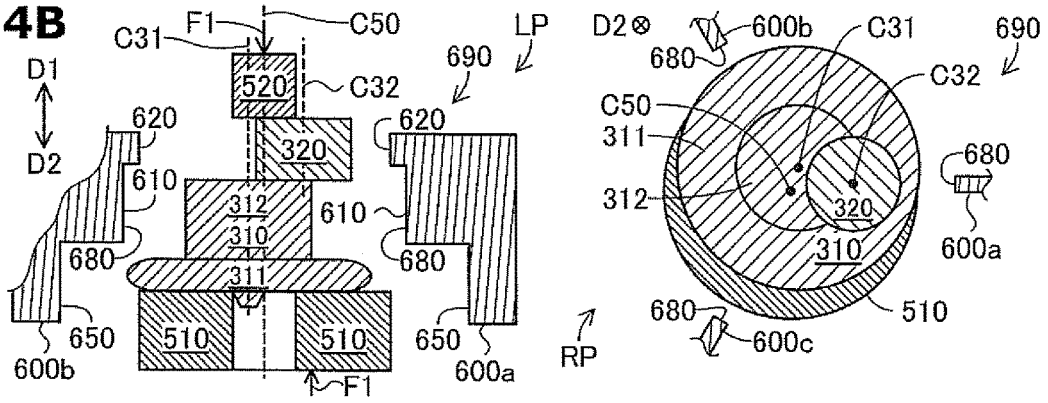

At step S220 (FIG. 3), the supporting member 310 and the second tip 320 are held by the two holders 510 and 520. In the present embodiment, the second holder 520 presses the second tip 320. With this operation, as shown in FIG. 4B, the supporting member 310 and the second tip 320 are sandwiched between the two holders 510 and 520. The supporting member 310 and the second tip 320 are held by the two holders 510 and 520 with these members 310 and 320 being in contact with each other.

The holders 510 and 520 are each connected to a first movement mechanism (not shown). The first movement mechanism supports the second holder 520 movably along the center axis C50 relative to the first holder 510. As such movement mechanism, various mechanisms such as a link mechanism and a slide rail can be employed. The first movement mechanism is provided with a power source such as an electric motor, and provides the holders 510 and 520 with a force in a direction that brings the holders 510 and 520 closer to each other and a force in a direction that separates the holders 510 and 520 from each other. In the drawings, a first force F1 is a force (called a sandwiching force) that sandwiches the members 310 and 320 by the holders 510 and 520. In the present embodiment, the first force F1 is exerted in a direction parallel to the first direction D1. The first movement mechanism provides the first holder 510 with the first force F1 in the first direction D1 and provides the second holder 520 with the first force F1 in the second direction D2.

At step S230 (FIG. 3), a plurality of nails of a chuck are moved toward the members 310 and 320. As shown on the right side RP in FIG. 4B, the plurality of nails (in the present embodiment, three nails 600*a*, 600*b* and 600*c*) of the chuck 690 are arranged around the members 310 and 320. More specifically, the nails 600*a*, 600*b* and 600*c* of the chuck 690 are arranged at separate positions that surround a contact portion of the members 310 and 320. In the present embodiment, the nails 600*a*, 600*b* and 600*c* are arranged at substantially equiangular intervals (at substantially regular intervals in the circumferential direction) with the center axis C50 of the holders 510 and 520 being a center. Shapes of the nails 600*a*, 600*b* and 600*c* are substantially the same.

As can be understood from the drawing on the right side RP in FIG. 4B, no nail is arranged at an opposite side to the first nail 600*a* with respect to the center axis C50. However, for convenience for explanation, in each drawing on the left side LP in FIGS. 4B to 5B, a position relationship between the first nail 600*a*, the second nail 600*b*, the members 310 and 320 and the holders 510 and 520 is schematically illustrated on one drawing. That is, in each drawing on the left side LP, a right side part of the center axis C50 schematically shows a position relationship between the first nail 600*a*, the members 310 and 320 and the holders 510 and 520, whereas a left side part of the center axis C50 schematically shows a position relationship between the second nail 600*b*, the members 310 and 320 and the holders 510 and 520.

As shown on the left side LP in FIG. 4B, each of the nails 600*a*, 600*b* and 600*c* has, at an inner peripheral side portion thereof, a holding portion 680. The holding portion 680 is formed by three portions 610, 620 and 650. Inner peripheral surfaces of these portions 610, 620 and 650 are each parallel to the center axis C50. The first portion 610 is a portion formed so as to contact an outer peripheral surface of the first member 310 (here, an outer peripheral surface of the small diameter portion 312). The second portion 620 is a portion formed so as to contact an outer peripheral surface of the second member 320. The third portion 650 is a portion formed so as to contact an outer peripheral surface of the first holder 510. As described later, when the center axes C31, C32 and C50 of the members 310, 320 and 510 are aligned with each other, the portions 610, 620 and 650 of each of the first to third nails 600*a* to 600*c* can contact the outer peripheral surfaces of the members 310, 320 and 510 respectively.

Each of the nails 600*a*, 600*b* and 600*c* is connected to a second movement mechanism (not shown). The second movement mechanism supports each of the nails 600*a*, 600*b* and 600*c* movably along a radial direction of a circle whose center is the center axis C50. As such movement mechanism, various mechanisms such as a link mechanism and a slide rail can be employed. The second movement mechanism is provided with a power source such as an electric motor, and provides each of the nails 600*a*, 600*b* and 600*c* with a force in a radially inward direction (in other words, in an inner peripheral direction) and a force in a radially outward direction (in other words, in an outer peripheral direction). The force in the radially inward direction is a force that brings the nails 600*a*, 600*b* and 600*c* closer to each other.

Figure 4C:
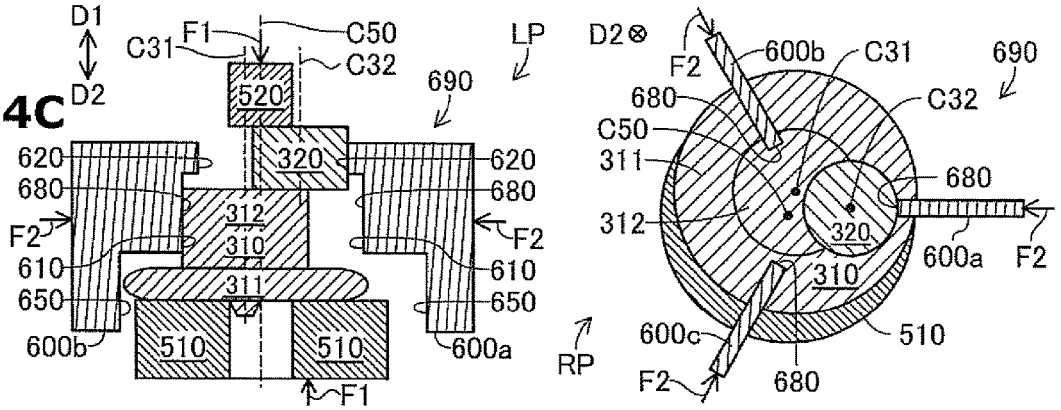

At step S230 (FIG. 3), as shown in FIG. 4C, the second movement mechanism provides each of the nails 600*a*, 600*b* and 600*c* with a second force F2 in the radially inward direction. In the present embodiment, the second force F2 is exerted in a direction perpendicular to the first direction D1. With this operation, each of the nails 600*a*, 600*b* and 600*c* moves in the radially inward direction perpendicular to the first direction D1 until each of the nails 600*a*, 600*b* and 600*c* contacts at least one of the members 310, 320 and 510. In the present embodiment, the aforementioned first force (the sandwiching force) F1 by the holders 510 and 520 is greater than the second force F2 that brings the nails 600*a*, 600*b* and 600*c* closer to each other. Therefore, when the nails 600*a*, 600*b* and 600*c* contact at least one of the members 310, 320 and 510, the nails 600*a*, 600*b* and 600*c* cannot move the contacting member, and stop at respective contact positions. In an example shown in FIG. 4C, the first nail 600*a* contacts only the second tip 320, the second nail 600*b* contacts only the supporting member 310, and the third nail 600*c* contacts only the first holder 510.

As described above, at steps S210 and S220 (FIG. 3), a relative position between the members 310 and 320 and the holder 510 is not adjusted (aligned) yet. As shown in FIG. 4C, when the center axes C31, C32 and C50 of the members 310, 320 and 510 are separate from each other (i.e. when the center axes C31, C32 and C50 of the members 310, 320 and 510 are not aligned with each other), each nail can contact only the member which is located at a closest position to the nail. In the following description, a nail that contacts only the first member 310 is also called a first type nail. A nail that contacts only the second member 320 is also called a second type nail. A nail that contacts only the first holder 510 is also called a third type nail. In a case where the number of nails is N (where N is an integer that is 2 or greater), the total number L of the first type nails is equal to or greater than 1 and equal to or less than N−1. The total number M of the second type nails is equal to or greater than 1 and equal to or less than N−L. In the present embodiment, each of the nails 600*a*, 600*b* and 600*c* can contact the first holder 510. Therefore, the total number K of the third type nails is equal to or greater than 1. When the total number K of the third type nails is equal to or greater than 1, the total number L of the first type nails is equal to or greater than 1 and equal to or less than N−2, and the total number M of the second type nails is equal to or greater than 1 and equal to or less than N−L−K.

Figure 4D:
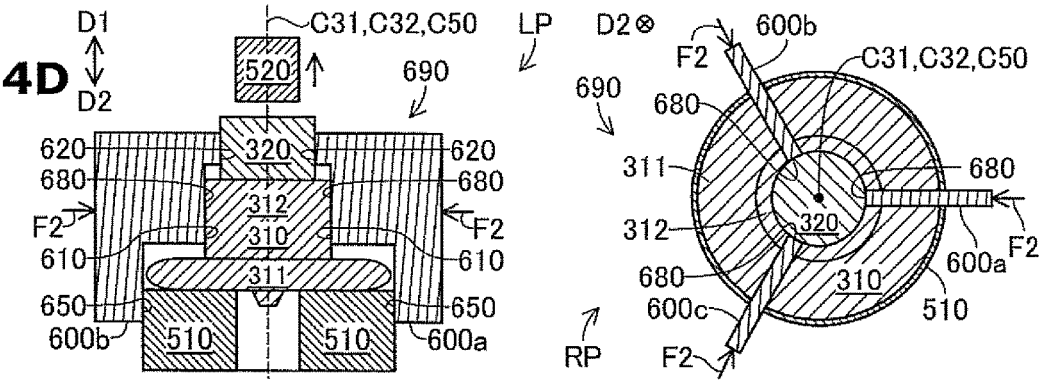

At step S240 (FIG. 3), the second holder 520 is separated from the second tip 320. In the present embodiment, as shown in FIG. 4D, the second holder 520 moves in the first direction D1. With this operation, the first force F1, having stopped relative movements of the members 510, 310 and 320, is not exerted. Therefore, the nails 600*a*, 600*b* and 600*c* can move so as to get even closer to each other. With this movement, a relative position of the members 310 and 320 (especially, a relative position in a direction crossing the first direction D1) is adjusted. In examples shown in FIGS. 4C and 4D, the nails 600*a*, 600*b* and 600*c* move the members 310 and 320 in the radially inward direction (in other words, in the inner peripheral direction) perpendicular to the first direction D1. With this operation, the relative position of the members 310 and 320 is adjusted so that the center axes C31 and C32 of the members 310 and 320 are substantially fully aligned with each other. Further, the nails 600*a*, 600*b* and 600*c* move the first member 310 relative to the first holder 510 in the direction crossing the first direction D1 (here, in the direction perpendicular to the first direction D1), and adjust a relative position of the first member 310 with respect to the first holder 510. In examples shown in FIGS. 4C and 4D, the relative position of the first holder 510 and the first member 310 is adjusted so that the center axes C50 and C31 of the first holder 510 and the first member 310 are substantially fully aligned with each other.

As described above, at step S240, the nails 600*a*, 600*b* and 600*c* move inwards in the inner peripheral direction so as to get even closer to each other up to the respective positions where each of the 600*a*, 600*b* and 600*c* contacts the members 510, 310 and 320 (see FIG. 4D). In the following description, these positions of the nails 600*a*, 600*b* and 600*c* are called a target nail position. Further, the relative position of the members 310 and 320 when the nails 600*a*, 600*b* and 600*c* are located at the target nail position is called a target member position. When the nails 600*a*, 600*b* and 600*c* are located at the target nail position, the inner peripheral surfaces of the portions 610, 620 and 650 of each of three nails 600*a*, 600*b* and 600*c* are positioned as follows. The inner peripheral surfaces of the three first portions 610 are positioned on the substantially same cylindrical surface as the outer peripheral surface of the first member 310 (here, the outer peripheral surface of the small diameter portion 312). The inner peripheral surfaces of the three second portions 620 are positioned on the substantially same cylindrical surface as the outer peripheral surface of the second member 320. The inner peripheral surfaces of the three third portions 650 are positioned on the substantially same cylindrical surface as the outer peripheral surface of the first holder 510. In this manner, radial direction positions of the inner peripheral surfaces of the portions 610, 620 and 650 of the nails 600*a*, 600*b* and 600*c* correspond to the respective outside diameters of the members 310, 320 and 510 which the portions 610, 620 and 650 contact respectively.

Figure 5A:
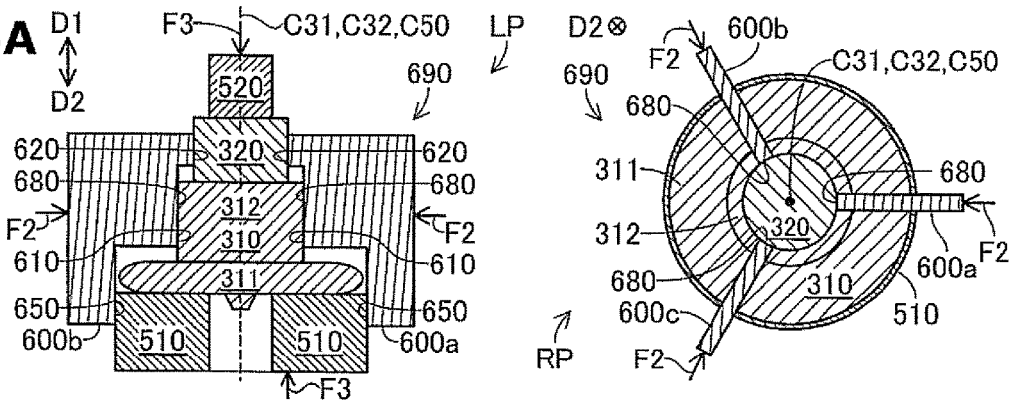
FIGS. 5A to 5C are drawings schematically showing change of the state (the position relationship) of the first member 310 and the second member 320.

At step S250 (FIG. 3), the second holder 520 presses the second tip 320 again. As shown in FIG. 5A, the holders 510 and 520 hold the members 310 and 320, having been located at the adjusted relative position, with the members 310 and 320 being in contact with each other. In the drawings, a third force F3 is a force that sandwiches the members 310 and 320 by the holders 510 and 520. It is preferable that a magnitude of this third force F3 be sufficient to suppress a change of the relative position of the members 310 and 320. Here, the magnitude of the third force F3 could be the same as that of the first force F1 (FIG. 4B), or could be different form the magnitude of the first force F1.

Figure 5B:
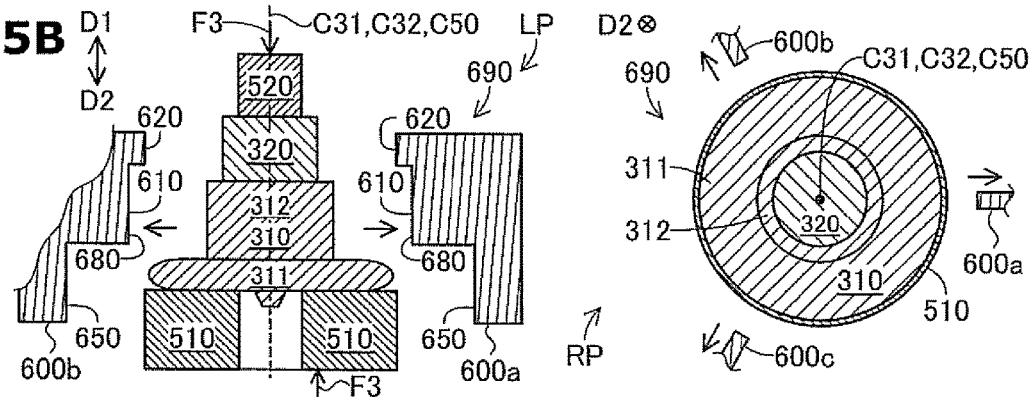

At step S260 (FIG. 3), the chuck 690 is removed from the members 310 and 320. As shown in FIG. 5B, the nails 600*a*, 600*b* and 600*c* of the chuck 690 are moved in the radially outward direction. With this operation, all the nails 600*a*, 600*b* and 600*c* of the chuck 690 are separated from the members 310 and 320.

Figure 5C:
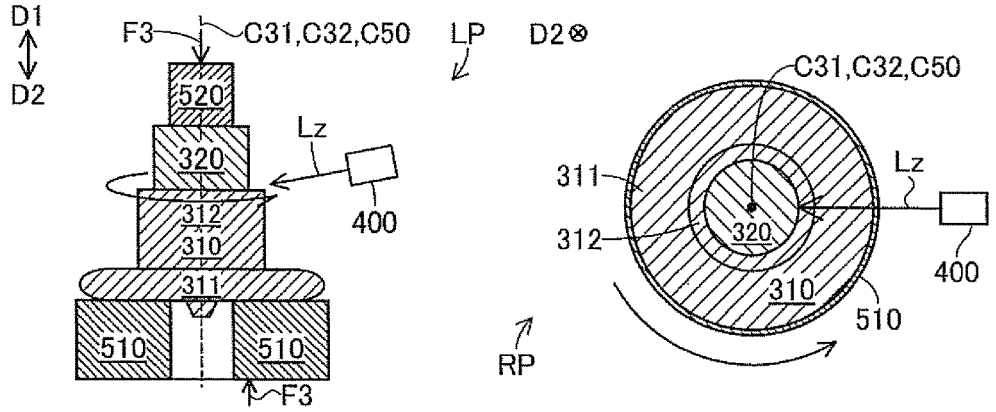

At step S270 (FIG. 3), a contact portion of the members 310 and 320 is welded. As shown in FIG. 5C, in the present embodiment, the members 310 and 320 are laser-welded by laser beam Lz from a laser device 400. For instance, the laser beam Lz is radiated to the contact portion of the members 310 and 320 from a predetermined position in a circumferential direction of a circle whose center is the center axes C31 and C32. In this state, the holders 510 and 520 turn or rotate with the center axis C50 being a center of rotation. The members 310 and 320 also turn or rotate with the center axis C50 (i.e. the center axes C31 and C32) being a center of rotation. With this operation, the contact portion of the members 310 and 320 is welded throughout the entire circumference of the contact portion. Instead of the rotation of the members 310 and 320, the laser device 400 could rotate around the contact portion of the members 310 and 320 with the center axes C31 and C32 being a center of rotation.

By the above processes, the composite tip 300 is produced. After completion of the production process of the composite tip 300 (FIG. 3), i.e. subsequent to step S120 (FIG. 2), at step S130, the ground electrode 30 is produced using the composite tip 300. In the present embodiment, the composite tip 300 is welded to the bar-shaped main body 37 (e.g. by laser-welding).

At step S140 (FIG. 2), the center electrode 20 is produced. As described above, the center electrode 20 is a composite formed by joining the rod portion 28 and the first tip 29 together. In the following description, the center electrode 20 is also called a second composite 20. The joining of the rod portion 28 and the first tip 29 is carried out by the same procedure as FIG. 3. FIGS. 6A to 6F are drawings schematically showing change of a state (a position relationship) of the rod portion 28 (also called a first member 28) and the first tip 29 (also called a second member 29) in the production process of the center electrode 20. When producing the center electrode 20, the state (the position relationship) of the first member 28 and the second member 29 changes in an order of FIGS. 6A to 6F. In FIGS. 6A to 6F, schematic views like the left side LP pf of FIGS. 4A to 5C are illustrated.

Figure 6A:
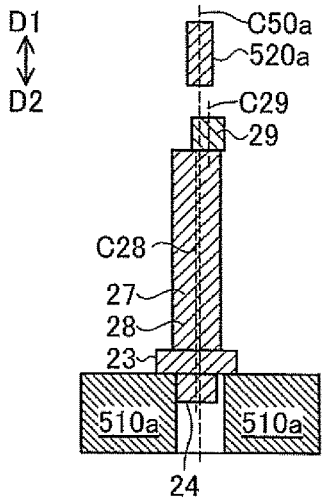
FIGS. 6A to 6F are drawings schematically showing change of a state (a position relationship) of a first member 28 and a second member 29.

FIG. 6A shows a state of step S210 (FIG. 3). The first member 28 and the second member 29 are placed between a first holder 510*a* and the second holder 520*a*. The first holder 510*a* is a cylindrical member whose axis is a center axis C50*a*. The second holder 520*a* is a cylindrical columned member whose axis is the center axis C50*a*. The second holder 520*a* is located at a first direction D1 side of the first holder 510*a*. The first member 28 is put on a surface on the first direction D1 side of the first holder 510*a*. The second member 29 is put on a surface on the first direction D1 side of the first member 28. In the present embodiment, the head portion 24 of the first member 28 is inserted into a hole of the first holder 510*a*, and the brim portion 23 of the first member 28 is put on the surface on the first direction D1 side of the first holder 510*a*. The center axis C50*a* of the first and second holders 510*a* and 520*a*, a center axis C28 of the first member 28 and a center axis C29 of the second member 29 may not be aligned with each other.

Figure 6B:
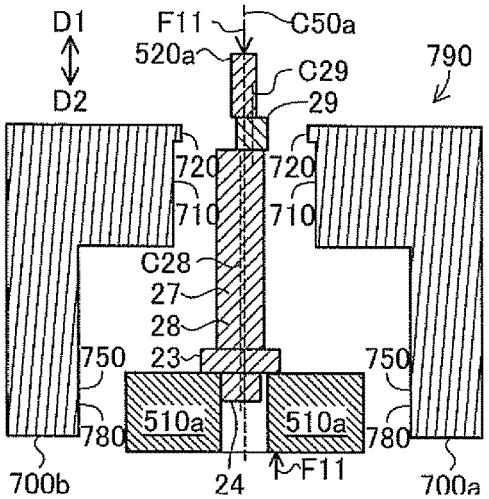

FIG. 6B shows a state of step S220 (FIG. 3). The second holder 520*a* presses the second member 29. The first and second holders 510*a* and 520*a* sandwich the members 28 and 29 by a first force F11. The first force F11 is exerted in a direction parallel to the first direction D1. A plurality of nails 700*a* and 700*b* of a chuck 790 are arranged around the members 28 and 29. The chuck 790 has three nails (although a third nail is not shown in the drawings), in the same manner as the chuck 690 shown in FIG. 4B. Shapes of the three nails are substantially the same. These three nails are arranged at substantially equiangular intervals (at substantially regular intervals in a circumferential direction) with the center axis C50*a* of the holders 510*a* and 520*a* being a center, in the same manner as the three nails 600*a*, 600*b* and 600*c* shown on the right side RP in FIG. 4B. For convenience for explanation, in each of FIGS. 6B to 6F, a position relationship between the first nail 700*a*, the second nail 700*b*, the members 28 and 29 and the holders 510*a* and 520*a* is schematically illustrated on one drawing. That is, in each drawing, a right side part of the center axis C50*a* schematically shows a position relationship between the first nail 700*a*, the members 28 and 29 and the holders 510*a* and 520*a*, whereas a left side part of the center axis C50*a* schematically shows a position relationship between the second nail 700*b*, the members 28 and 29 and the holders 510*a* and 520*a*.

Each of the nails 700*a*, 700*b* and 700*c* has, at an inner peripheral side thereof, a holding portion 780. The holding portion 780 is formed by three portions 710, 720 and 750. Inner peripheral surfaces of these portions 710, 720 and 750 are each parallel to the center axis C50*a*. The first portion 710 is a portion formed so as to contact an outer peripheral surface of the first member 28 (here, an outer peripheral surface of the shaft portion 27). The second portion 720 is a portion formed so as to contact an outer peripheral surface of the second member 29. The third portion 750 is a portion formed so as to contact an outer peripheral surface of the first holder 510*a*. The three nails 700*a*, 700*b* and 700*c* of the chuck 790 are each moved by a movement mechanism, in the same manner as the three nails 600*a*, 600*b* and 600*c* shown in FIG. 4B.

Figure 6C:
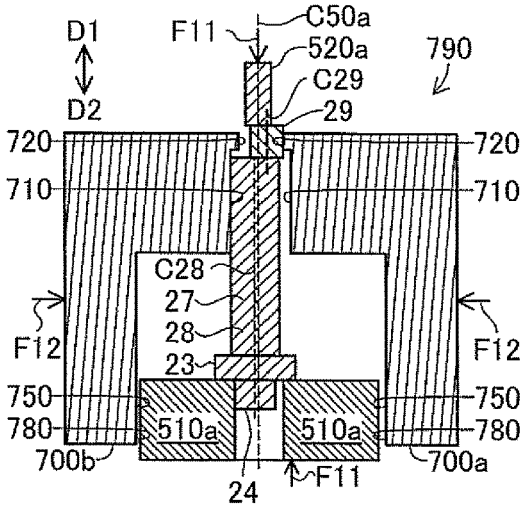

FIG. 6C shows a state of step S230 (FIG. 3). The movement mechanism provides each of the nails 700*a*, 700*b* and 700*c* of the chuck 790 with a second force F12 in the radially inward direction. In the present embodiment, the second force F12 is exerted in a direction perpendicular to the first direction D1. In an example shown in FIG. 6C, the first nail 700*a* contacts only the second member 29, and the second nail 700*b* contacts only the first member 28.

Figure 6D:
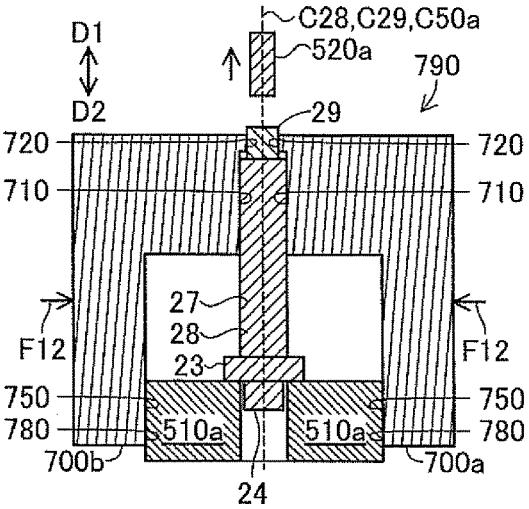

FIG. 6D shows a state of step S240 (FIG. 3). By separating the second holder 520*a* from the second member 29, the three nails 700*a*, 700*b* and 700*c* of the chuck 790 move in the radially inward direction (in other words, in the inner peripheral direction) so as to get even closer to each other. With this movement, a relative position in a direction perpendicular to the first direction D1 of the members 28 and 29 is adjusted by the three nails of the chuck 790. In the present embodiment, the relative position of the members 28 and 29 is adjusted so that the center axes C28 and C29 of the members 28 and 29 are substantially fully aligned with each other. Further, the three nails of the chuck 790 adjust a relative position in a direction perpendicular to the first direction D1 of the first member 28 with respect to the first holder 510*a*. In the present embodiment, the relative position of the first holder 510*a* and the first member 28 is adjusted so that the center axes C50*a* and C28 of the first holder 510*a* and the first member 28 are substantially fully aligned with each other.

Figure 6E:
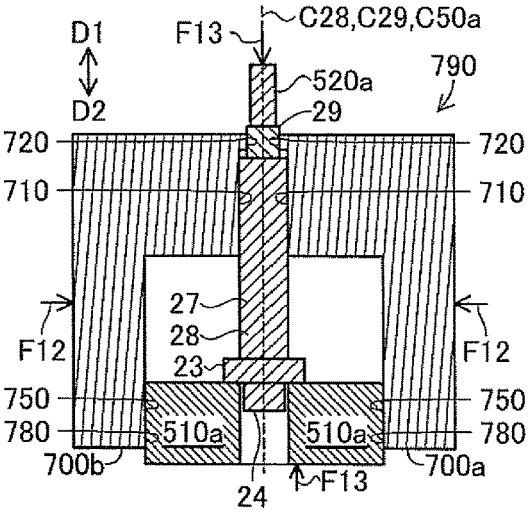
Figure 6F:
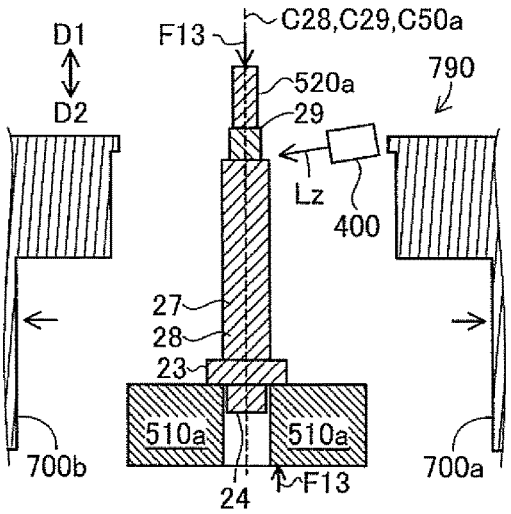

FIG. 6E shows a state of step S250 (FIG. 3). The holders 510*a* and 520*a* hold and sandwich the members 28 and 29, having been located at the adjusted relative position, with the members 28 and 29 being in contact with each other FIG. 6F shows a state of steps S260 and S270 (FIG. 3). All the nails 700*a*, 700*b* and 700*c* of the chuck 790 are separated and removed from the members 28 and 29. Further, a contact portion of the members 28 and 29 is laser-welded by laser beam Lz from the laser device 400. In the present embodiment, the laser device 400 does not move (does not rotate), but the holders 510*a* and 520*a* turn or rotate with the center axis C50*a* being a center of rotation. The members 28 and 29 also turn or rotate with the center axes C28 and C29 being a center of rotation. With this operation, the contact portion of the members 28 and 29 is welded by laser beam Lz throughout the entire circumference of the contact portion.

By the above processes, the center electrode 20 is produced, namely that step S140 in FIG. 2 is ended. Here, the production of the center electrode 20 (i.e. step S140) and the production of the composite tip 300 (i.e. step S120) could be carried out independently. For instance, step S140 could be carried out before step S120.

At step S150 in FIG. 2, the ignition plug 100 is produced using the member prepared for the ignition plug 100. The ignition plug 100 is produced, for instance, by the following method. An assembly having the insulator 10, the center electrode 20 and the metal terminal 40 is prepared. For instance, the center electrode 20 is inserted into an opening on the rear direction Dfr side of the insulator 10. The center electrode 20 is supported by the reduced-inside diameter portion 11 of the insulator 10, and set or fitted at a predetermined position in the penetration hole 12. Next, charge of the powders of the materials of the first seal member 72, the resistor 73 and the second seal member 74 and their molding are carried out in an order of the members 72, 73, 74. The powders of the materials are charged into the penetration hole 12 from the opening on the rear direction Dfr side of the insulator 10. Subsequently, the insulator 10 is heated up to a predetermined temperature that is higher than a softening point of a glass component contained in the material powders of the members 72, 73 and 74. And, in the heated state at the predetermined temperature, the rod-shaped portion 41 on the front direction Df side of the metal terminal 40 is inserted into the axis hole 12 from the opening on the rear direction Dfr side of the insulator 10. As a consequence, the material powders of the members 72, 73 and 74 are compressed and sintered, then the first seal member 72, the resistor 73 and the second seal member 74 are formed. Afterwards, the metal terminal 40 is fixed to the insulator 10.

Apart from the preparation of the assembly including the insulator 10, the ground electrode 30 is connected to the metal shell 50 (e.g. by resistance welding). Then, the above assembly including the insulator 10 is fixed to the metal shell 50. More specifically, the top end side packing 8, the assembly, the ring member 62, the talc 70 and the ring member 61 are inserted into the penetration hole 59 of the metal shell 50, and the rear end portion 53 of the metal shell 50 is caulked by being bent in the radially inward direction, then the insulator 10 is fixed to the metal shell 50. Finally, by bending or curving the bar-shaped ground electrode 30, a distance of the gap g is adjusted. In this way, the ignition plug 100 is completed.

The above production method of the composite tip 300 brings the following advantages. At steps S210 and S220 (FIG. 3) corresponding to FIGS. 4A and 4B, the first member 310 and the second member 320 arranged in the first direction D1 are sandwiched between the first holder 510 and the second holder 520 set at the separate positions in the first direction D1. With this operation, the first member 310 and the second member 320 are held with these members 310 and 320 being in contact with each other. At step S230 corresponding to FIG. 4C, in the state in which the first member 310 and the second member 320 are held by the first holder 510 and the second holder 520, the three nails 600*a*, 600*b* and 600*c* of the chuck 690, arranged at the separate positions that surround the contact portion of the first member 310 and the second member 320, are provided with the second force F2 that brings the three nails 600*a*, 600*b* and 600*c* closer to each other. With this operation, at least one first type nail (in the example in FIG. 4C, one nail 600*a*) of the three nails 600*a*, 600*b* and 600*c* contacts the first member 310 without contacting the second member 320. Further, at least one second type nail (in the example in FIG. 4C, one nail 600*b*) other than the first type nail contacts the second member 320 without contacting the first member 310. Since the first member 310 and the second member 320 are sandwiched between the first holder 510 and the second holder 520, a large shift or a considerable change of the relative position of the members 310 and 320, which is caused by the contact of the first member 310 and the nail 600*a* and the contact of the second member 320 and the nail 600*b*, can be suppressed.

If the nail 600*b* contacts the second member 320 in a state in which the first member 310 and the second member 320 are not sandwiched between the first holder 510 and the second holder 520, the second member 320 would move unintentionally to a position that is separate from the first member 310 by the force received from the nail 600*b*. Especially when the second member 320 is a small member, this problem tends to occur. However, the present embodiment can suppress this problem.

At step S240 corresponding to FIG. 4D, the second holder 520 is separated from the second member 320 in the state in which the first type nail (in the example in FIG. 4C, the nail 600*a*) contacts the first member 310 and the second type nail (in the example in FIG. 4C, the nail 600*b*) contacts the second member 320. With this operation, the three nails 600*a*, 600*b* and 600*c* move so as to get even closer to each other, and the second member 320 moves relative to the first member 310 in the direction crossing the first direction D1. As a consequence, the relative position of the first member 310 and the second member 320 is properly adjusted. In the present embodiment, the relative position of the first member 310 and the second member 320 is adjusted so that the center axes C31 and C32 of the first member 310 and the second member 320 are substantially fully aligned with each other.

At step S250 corresponding to FIG. 5A, the second holder 520 presses the second member 320 again. With this operation, the first member 310 and the second member 320, having been located at the adjusted relative position, are held with the members 310 and 320 being in contact with each other. At step S260 corresponding to FIG. 5B, the chuck 690 is removed from the first member 310 and the second member 320 in the state in which the first member 310 and the second member 320 are held. At step S270 corresponding to FIG. 5C, after removing the chuck 690, the contact portion of the first member 310 and the second member 320 is laser-welded in the state in which the first member 310 and the second member 320 are held. In this manner, the first member 310 and the second member 320, having been located at the adjusted relative position, are held with the members 310 and 320 being in contact with each other, and the chuck 690 is removed in this state, then the first member 310 and the second member 320 are laser-welded. Therefore, the first member 310 and the second member 320 can be joined at the proper relative position. Further, since the first member 310 and the second member 320, having been located at the proper relative position, are laser-welded, this can stabilize the welding. For instance, spatter can be suppressed.

In addition, as explained in FIG. 4D, each of the three nails 600*a*, 600*b* and 600*c* has the first to third portions 610, 620 and 650 formed so as to contact the members 310, 320 and 510 respectively at step S240. Then, at step S240, by separating the second holder 520 from the second member 320, the three nails 600*a*, 600*b* and 600*c* get even closer to each other, and the first member 310 moves relative to the first holder 510 in the direction crossing the first direction D1. The relative position of the first holder 510 and the first member 310 is thus adjusted. Consequently, the laser-welding can be performed to the first member 310, having been located at a proper relative position with respect to the first holder 510, and the second member 320. A proper welding can therefore be carried out. For instance, a direction of the laser device 400 is previously adjusted to a predetermined position with respect to the first holder 510, that is, the laser device 400 is previously set so that the laser beam Lz is radiated toward a certain position at which the contact portion of the first member 310 and the second member 320 is located. With this setting, the frequency of adjustment of radiation position of the laser beam Lz is reduced as compared with a case where the radiation position of the laser beam Lz is adjusted every time the welding is performed. This facilities production of a plurality of composite tips 300. Further, when producing the plurality of composite tips 300, since a change of a distance between the laser device 400 and a welding point is suppressed, a stable welding can be achieved.

As explained in FIG. 4C, at step S230, the sandwiching force F1 by the first and second holders 510 and 520 is set to be greater than the second force F2 that brings the three nails 600*a*, 600*b* and 600*c* of the chuck 690 closer to each other. Therefore, either one or both of the first member 310 and the second member 320 is prevented from moving by the force received from the nail. As a result, at step S240, it is possible to properly adjust the relative position of the first holder 510 and the first member 310.

Further, the total number of the nails 600*a*, 600*b* and 600*c* of the chuck 690 is three. These nails 600*a*, 600*b* and 600*c* can contact the first member 310 and the second member 320 at the separate positions that surround the contact portion of first member 310 and the second member 320. Therefore, even in a case where a not-yet-adjusted relative position of the first member 310 and the second member 320 is greatly shifted from the target member position, it is possible to properly adjust the relative position of the first member 310 and the second member 320 by the nails 600*a*, 600*b* and 600*c*.

Moreover, as explained in FIGS. 4B to 4D, each of the three nails 600*a*, 600*b* and 600*c* has the holding portion 680. The holding portion 680 has the first portion 610 formed so as to contact the first member 310 at step S240 and the second portion 620 formed so as to contact the second member 320 at step S240. At step S240, the three holding portions 680 of the three nails 600*a*, 600*b* and 600*c* are arranged at the separate positions so as to surround the contact portion of the first member 310 and the second member 320. The total number of the holding portions 680 is three. Therefore, even in a case where a not-yet-adjusted relative position of the first member 310 and the second member 320 is greatly shifted from the target member position, it is possible to properly adjust the relative position of the first member 310 and the second member 320 by the plurality of holding portions 680 of the nails 600*a*, 600*b* and 600*c*.

The production method of the composite tip 300 has been explained as described above. In the present embodiment, the center electrode 20 is also produced by the same method as the production method of the composite tip 300. Therefore, the production method of the center electrode 20 also brings the various advantages, in the same manner as the production method of the composite tip 300.

Furthermore, in the present embodiment, the composite tip 300 and the center electrode 20, as an example of the composite, are produced by the above-described production method. The ground electrode 30 is produced using the composite tip 300 produced by the above-described production method. The ignition plug 100 is produced using the produced center electrode 20 and the produced ground electrode 30. As a consequence, the ignition plug 100 having proper electrodes 20 and 30 can be produced.

Second Embodiment

Figure 7A:
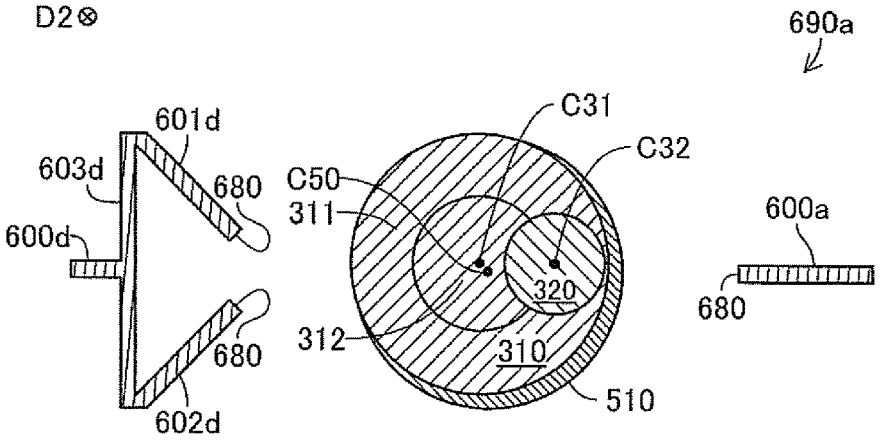
FIGS. 7A to 7C are drawings schematically showing a chuck according to other embodiment.
Figure 7B:
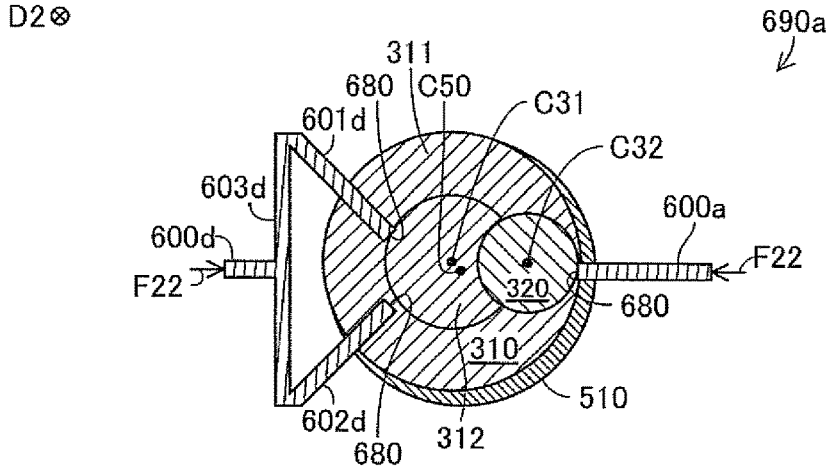
Figure 7C:
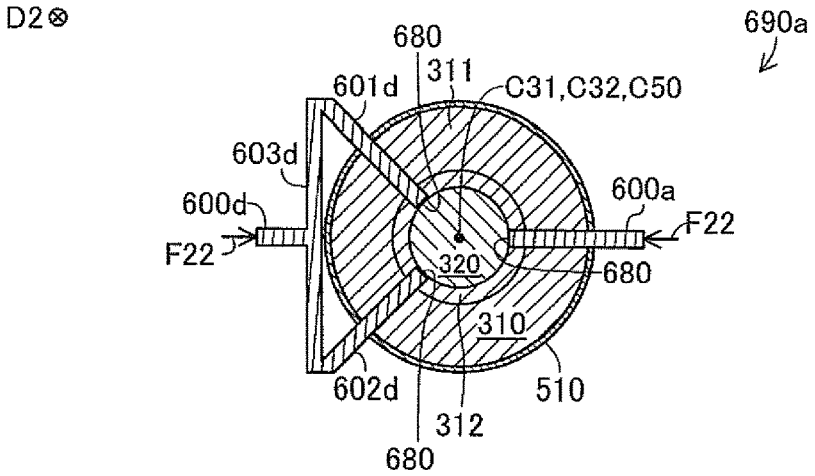

FIGS. 7A to 7C are drawings schematically showing a chuck according to other embodiment. In FIGS. 7A to 7C, schematic views viewed from the second direction D2, like the right side RP pf of FIG. 4B etc., are illustrated. A difference from the chuck 690 of the first embodiment is that the two nails 600*b* and 600*c* are changed to one nail 600*d*. A chuck 690*a* of the present embodiment has two nails of a first nail 600*a* and a second nail 600*d*. The chuck 690*a* can be used instead of the chuck 690 in the production method shown in FIGS. 2 and 3.

FIG. 7A shows a state of step S220 (FIG. 3), which corresponds to FIG. 4B. As can be seen from FIG. 7A, the second nail 600*d* has three portions 601*d*, 602*d* and 603*d*. Shapes of the first portion 601*d* and the second portion 602*d* are the same as those of the nails 600*a*, 600*b* and 600*c* shown in FIG. 4D. The first nail 600*a*, the first portion 601*d* and the second portion 602*d* are arranged at separate positions that surround a contact portion of the members 310 and 320. Each of the first portion 601*d* and the second portion 602*d* has, at an inner peripheral side portion thereof, the holding portion 680. The one second nail 600*d* therefore has the two holding portions 680 that are separate from each other. The third portion 603*d* connects outer peripheral side portions of the first portion 601*d* and the second portion 602*d*. The two nails 600*a* and 600*d* are arranged at positions opposite to each other with respect to the center axis C50. The three holding portions 680 of the two nails 600*a* and 600*d* are arranged at separate positions so as to surround the contact portion of the first member 310 and the second member 320.

FIG. 7B shows a state of step S230 (FIG. 3), which corresponds to FIG. 4C. Each of the two nails 600*a* and 600*d* of the chuck 690*a* is provided with a force F22 in the radially inward direction (in the inner peripheral direction). Each of the nails 600*a* and 600*d* moves in the radially inward direction until each of the nails 600*a* and 600*d* contacts at least one of the members 310, 320 and 510. Here, the sandwiching force F1 (see FIG. 4C) by the holders 510 and 520 is greater than the force F22 provided to the nails 600*a* and 600*d*. Therefore, when the nails 600*a* and 600*d* contact at least one of the members 310, 320 and 510, the nails 600*a* and 600*d* cannot move the contacting member, and stop at respective contact positions. In an example shown in FIG. 7B, the first nail 600*a* contacts only the second tip 320, and the first portion 601*d* of the second nail 600*d* contacts only the supporting member 310. The second portion 602*d* of the second nail 600*d* is separate from all of the members 310, 320 and 510.

FIG. 7C shows a state of step S240 (FIG. 3), which corresponds to FIG. 4D. The nails 600*a* and 600*d* move inwards in the inner peripheral direction so as to get even closer to each other up to the respective positions where each of the nails 600*a* and 600*d* contacts the members 510, 310 and 320. With this movement, a relative position of the members 310 and 320 (especially, a relative position in a direction crossing the first direction D1) is adjusted. Likewise, a relative position of the first members 510 and 310 is adjusted. In the same manner as the three holding portions 680 of the three nails 600*a*, 600*b* and 600*c* as shown in FIG. 4D, each of the three holding portions 680 of the two nails 600*a* and 600*d* contacts the members 510, 310 and 320 as shown in FIG. 7C. In the following description, these positions of the nails 600*a* and 600*d* are called a target nail position. The relative position of the members 310 and 320 (i.e. FIG. 7C) when the nails 600*a* and 600*d* are located at the target nail position is the same as the target member position shown in FIG. 4D.

When the nails 600*a* and 600*d* are located at the target nail position, inner peripheral surfaces of the portions 610, 620 and 650 (see FIG. 4D) of the three holding portions 680 of the two nails 600*a* and 600*d* are positioned as follows. The inner peripheral surfaces of the three first portions 610 are positioned on the substantially same cylindrical surface as the outer peripheral surface of the first member 310. The inner peripheral surfaces of the three second portions 620 are positioned on the substantially same cylindrical surface as the outer peripheral surface of the second member 320. The inner peripheral surfaces of the three third portions 650 are positioned on the substantially same cylindrical surface as the outer peripheral surface of the first holder 510. In this manner, radial direction positions of the inner peripheral surfaces of the portions 610, 620 and 650 of the three holding portions 680 of the two nails 600*a* and 600*d* correspond to the respective outside diameters of the members 310, 320 and 510 which the portions 610, 620 and 650 contact respectively.

As described above, the one second nail 600*d* could have a plurality of holding portions 680. Also in the case where the chuck 690*a* having such second nail 600*d* is used, the various advantages can be obtained, in the same manner as the case where the chuck 690 of the first embodiment is used.

MODIFIED EXAMPLES (1) The total number of the nails of the chuck used for adjustment of the relative position of the members 310 and 320 could be an arbitrary number that is 2 or greater. For instance, in the embodiment shown in FIGS. 4B to 5B, four nails whose shape is the same as that of the nails 600*a*, 600*b* and 600*c* could be used for the adjustment of the relative position. Further, two nails whose shape is the same as that of the second nail 600*d* shown in FIGS. 7A to 7C could be used. N nails could be formed by N nails having the same shape. Instead of this, N nails could be formed by N nails having different shapes.

(2) Configuration or structure of the nail of the chuck is not limited to that of the nails 600*a*, 600*b*, 600*c*, 700*a*, 700*b* and 600*d* shown in FIGS. 4D, 6D and 7C, but could be an arbitrary configuration or structure that is suitable for or fitted to the shapes of the first member and the second member which are to be joined together. For instance, the third portion 650 formed so as to contact the first holder 510 might be omitted from each of the nails 600*a* to 600*c* shown in FIG. 4D. In this manner, the nail could be formed so as to contact the first member and the second member without contacting the holder that holds the first member and the second member which are to be joined together. In this case, at step S240 (FIG. 3), L nails (where L is an integer that is equal to or greater than 1 and equal to or less than N−1) of N nails could each contact the first member 310 without contacting the second member 320, and M nails (where M is an integer that is equal to or greater than 1 and equal to or less than N−L) of N nails could each contact the second member 320 without contacting the first member 310. Here, at step S230, one or more nail could be separate from both of the members 310 and 320.

(3) The nail of the chuck has the holding portion having the first portion and the second portion formed so as to contact the first member and the second member which are to be joined together respectively. One nail could have one or more holding portions (i.e. the number of the holding portions provided at one nail is an arbitrary number that is 1 or greater). Further, the total number P of the plurality of holding portions of N nails could be an arbitrary number that is 2 or greater. Here, in order to adjust the relative position of the first member and the second member to the target member position by P holding portions even in a case where a not-yet-adjusted relative position of the first member and the second member is greatly shifted from the target member position, it is preferable that the total number P of the holding portions be 3 or greater. P holding portions could be formed by P holding portions having the same shape. Instead of this, P holding portions could be formed by P holding portions having different shapes.

(4) When adjusting the relative position of the first member and the second member which are to be joined together, N nails are arranged at the separate positions that surround the contact portion of the first member and the second member. In FIG. 4D in the embodiment, in the state in which the relative position of the first member 310 and the second member 320 is adjusted to the target member position, the three nails 600*a*, 600*b* and 600*c* (the three holding portions 680) are arranged at substantially regular intervals along a circumferential direction of a circle whose center is the center axes C31 and C32 of the first and second members 310 and 320. An arrangement of the nails 600*a*, 600*b* and 600*c* at step S230 (FIG. 3) is an arrangement where the nails 600*a*, 600*b* and 600*c* move from the target nail position as shown in FIG. 4D to the outer peripheral side in the radial direction of a circuit whose center is the center axes C31 and C32 of the first and second members 310 and 320. Here, distances or intervals between each two of the three nails 600*a*, 600*b* and 600*c* (between each two of the three holding portions 680) could be unequal. This is the same also in a case where the number N of the nails is not 3 or the total number P of the holding portions is not 3. In any case, in the operations at steps S230 and S240 (FIG. 3), the circumferential direction positions or intervals (e.g. positions or intervals in a circumferential direction of a circle whose center is the center axis of the first member), surrounding the contact portion of the first member and the second member, of N nails or P holding portions are different.

(5) Regarding configuration or structure of the chuck, instead of the chuck 690, 790 and 690*a* shown in FIGS. 4B, 6B and 7A, other configurations or structures can be employed. For instance, in FIG. 4C in the embodiment, the nails 600*a*, 600*b* and 600*c* of the chuck 690 could move toward a different axis from the center axis C50 of the first holder 510. In any case, it is preferable that when adjusting the relative position of the first member and the second member using the plurality of nails of the chuck, the chuck be configured so that the plurality of nails move toward the contact portion of the first member and the second member.

(6) A magnitude of the force for sandwiching the first member and the second member which are to be joined together might be equal to or less than a magnitude of the force for bringing the nails of the chuck closer to each other to adjust the relative position of the first member and the second member. For instance, magnitudes of the force F1 (FIG. 4B) and the force F11 (FIG. 6B) might be equal to or less than magnitudes of the force F2 (FIGS. 4C and 4D), the force F12 (FIGS. 6C and 6D) and the force F22 (FIGS. 7B and 7C). Also in this case, it is preferable that the force for sandwiching the first member and the second member be set to a sufficient magnitude to be able to suppress the change or shift of the relative position of the first member and the second member at step S230 (FIG. 3).

(7) In the production of the composite shown in FIG. 3, the first member and the second member which are to be joined together are placed so as to be arranged along the first direction D1. The first direction D1 is a direction leading from the first member to the second member. For instance, in FIG. 4A in the embodiment, the first direction D1 is a direction leading from the first member 310 to the second member 320. As the first direction D1, it could be a direction that is parallel to the center axis of the supporting member. Further, in the above embodiments, the first direction D1 is the upward direction in the vertical axis. However, the first direction D1 might be another direction that is different from the upward direction in the vertical axis. In this case, in order to prevent the second member from moving spontaneously or by itself (e.g. in order to prevent the second member from sliding and falling off the first member), it is preferable that a first angle, which is an angle formed between the first direction D1 leading from the first member to the second member and the upward direction in the vertical axis, be small. For instance, it is preferable that the first angle be 30 degrees or smaller. The first angle of 20 degrees or smaller is greatly preferable. The first angle of 10 degrees or smaller is very greatly preferable. It is most preferable that the first direction D1 be identical with the upward direction in the vertical axis.

Further, in order to suppress the change or shift of the relative position of the first member and the second member, it is preferable that, like the embodiments, a contact surface of the first member and the second member be perpendicular to the upward direction in the vertical axis. However, the contact surface might be inclined. In this case, it is preferable that a second angle, which is an angle formed between the upward direction in the vertical axis and a direction of the normal to the contact surface, be small. For instance, it is preferable that the second angle be 30 degrees or smaller. The second angle of 20 degrees or smaller is greatly preferable. The second angle of 10 degrees or smaller is very greatly preferable.

Moreover, in order to suppress the change or shift of the relative position of the first member and the second member when sandwiching the first member to the second member by the two holders, it is preferable that a direction of the sandwiching force by the two holders be a direction perpendicular to the contact surface of the first member and the second member. In the embodiments, the contact surface of the first member and the second member is substantially perpendicular to the first direction D1. And, the direction of the sandwiching force (e.g. the force F1 (FIG. 4B) and the force F11 (FIG. 6B)) is substantially parallel to the first direction D1. However, the direction of the sandwiching force might be inclined with respect to the normal direction perpendicular to the contact surface of the first member and the second member. In this case, it is preferable that a third angle, which is an angle formed between the direction of the sandwiching force and the direction of the normal to the contact surface, be small. For instance, it is preferable that the third angle be 30 degrees or smaller. The third angle of 20 degrees or smaller is greatly preferable. The third angle of 10 degrees or smaller is very greatly preferable.

Furthermore, in the embodiments, positions of the first member and the second member which are to be joined together could be opposite. For instance, in FIG. 4A in the embodiment, the second tip 320 could be put on the surface on the first direction D1 side of the first holder 510, and the supporting member 310 could be put on the surface on the front direction Df side of the second tip 320. In this case, the second tip 320 corresponds to the first member, and the supporting member 310 corresponds to the second member. Here, it is preferable that when putting the second member on the first member, the second member be smaller than the first member. For instance, it is preferable that an outside diameter of the second member be smaller than an outside diameter of the first member.

In any case, the holding portion of the nail of the chuck is formed according to an outside diameter of the member (including the first member and the second member which are to be joined together) which the holding portion contacts. For instance, the holding portion of the nail is formed as follows. Either one of the first and second members, an outside diameter of which is relatively small, is called a small diameter member, whereas the other of the first and second members, an outside diameter of which is relatively large, is called a large diameter member. A portion, formed so as to contact the small diameter member, of the holding portion of the nail is structured to relatively protrude in the inner peripheral direction. And, a portion, formed so as to contact the large diameter member, of the holding portion of the nail is structured to be relatively recessed in the outer peripheral direction.

(8) Regarding configuration or structure of the electrodes 20 and 30, instead of the electrodes shown in FIG. 1, other configurations or structures can be employed. For instance, the large diameter portion 311 of the supporting member 310 might be omitted. In this case, the small diameter portion 312 is joined to the main body 37. Instead of this, the small diameter portion 312 of the supporting member 310 might be omitted. In this case, the second tip 320 is joined to the large diameter portion 311. Further, the supporting member 310 of the ground electrode 30 might be omitted. In this case, the second tip 320 is joined to the main body 37. Furthermore, the composite tip 300 might be removed from the ground electrode 30. Also, the first tip 29 might be removed from the center electrode 20. In addition, the electrode formed using the composite including the first member and the second member could be only either one of the center electrode and the ground electrode.

(9) Regarding configuration or structure of the ignition plug 100, instead of the ignition plug shown in FIG. 1, other configurations or structures can be employed. For instance, the top end side packing 8 could be omitted. In this case, the bulging portion 56 of the metal shell 50 directly supports the reduced-outside diameter portion 16 of the insulator 10. Further, instead of the gap between a top end surface (a surface on the front direction Df side of the first tip 29 of FIG. 1) of the center electrode and the ground electrode, the discharge gap could be formed between a side surface (a surface facing to a direction perpendicular to the center axis CL of the ignition plug 100) of the center electrode and the ground electrode. The total number of the discharge gaps could be 2 or greater. Further, the ground electrode 30 could be omitted. In this case, electric discharge occurs between the center electrode 20 of the ignition plug 100 and other member provided in a combustion chamber.

EXPLANATION OF REFERENCE

8 . . . top end side packing
10 . . . insulator
11 . . . reduced-inside diameter portion
12 . . . penetration hole (axis hole)
16 . . . reduced-outside diameter portion
18 . . . reduced-outside diameter portion
20 . . . center electrode (second composite)
21 . . . outer layer
22 . . . core portion
23 . . . brim portion
24 . . . head portion
27 . . . shaft portion
28 . . . rod portion (first member)
29 . . . first tip (second member)
30 . . . ground electrode
31 . . . outer layer
32 . . . inner layer
33 . . . base end portion
34 . . . top end portion
37 . . . main body
40 . . . metal terminal
41 . . . portion (rod-shaped portion)
50 . . . metal shell
51 . . . tool engagement portion
53 . . . rear end portion
54 . . . middle body portion
54*f* . . . surface
55 . . . top end surface
56 . . . bulging portion
56*r* . . . rear surface
57 . . . thread portion
58 . . . connecting portion
59 . . . penetration hole
61 . . . ring member
62 . . . ring member
70 . . . talc
72 . . . first seal member
73 . . . resistor
74 . . . second seal member
100 . . . ignition plug (spark plug)
300 . . . composite tip
310 . . . supporting member (first member)
311 . . . large diameter portion
312 . . . small diameter portion
320 . . . second tip (second member)
400 . . . laser device
510, 510*a* . . . first holder
520, 520*a* . . . second holder
600*a*~600*d* . . . nail
601*d* . . . first portion
602*d* . . . second portion
603*d* . . . third portion
610 . . . first portion
620 . . . second portion
650 . . . third portion
680 . . . holding portion
690, 690*a* . . . chuck
700*a*, 700*b* . . . nail
710 . . . first portion
720 . . . second portion
750 . . . third portion
780 . . . holding portion

790 . . . chuck
g . . . gap
Df . . . top end direction (front direction)
Dfr . . . rear end direction (rear direction)
D1 . . . first direction
D2 . . . second direction
CL . . . center axis (center line, axis)
C28, C29, C31, C32, C50, C50*a* . . . center axis
Lz . . . laser beam The entire contents of Japanese Patent Applications No. 2018-108257 filed on Jun. 6, 2018 is incorporated herein by reference.

Although the invention has been described above by reference to certain embodiments of the invention, the invention is not limited to the embodiments described above. Modifications and variations of the embodiment described above will occur to those skilled in the art in light of the above teachings. The scope of the invention is defined with reference to the following claims.

What is claimed is:

1. A method of producing a composite for forming an electrode of an ignition plug, the composite having a first member and a second member joined to the first member, the method comprising:

a first holding step of, by a first holder and a second holder set at separate positions in a first direction, by sandwiching the first member and the second member arranged in the first direction, holding the first member and the second member with the first and second members being in contact with each other;

a contacting step of, by providing N nails, where N is an integer that is 2 or greater, of chucks that are arranged at separate positions so as to surround a contact portion of the first and second members with a force that brings the N nails closer to each other in a state in which the first member and the second member are held by the first holder and second holders, making each of L nails, where L is an integer that is equal to or greater than 1 and equal to or less than N−1, of the N nails contact with the first member without contacting the second member and making each of M nails, where M is an integer that is equal to or greater than 1 and equal to or less than N−L, contact with the second member without contacting the first member, wherein the M nails are different from the L nails;

a moving step of, by separating the second holder from the second member in a state in which each of the L nails contacts the first member and each of the M nails contacts the second member, bringing the N nails even closer to each other, moving the second member relative to the first member in a direction crossing the first direction and adjusting a relative position of the first member and the second member;

a second holding step of, by making the second holder contact with the second member again in a state in which the relative position of the first member and the second member is adjusted, holding the first member and the second member, which have been located at the adjusted relative position, with the first and second members being in contact with each other;

a removing step of removing the chucks from the first member and the second member in a state in which the first member and the second member are held; and a welding step of, after removing the chucks, laser-welding the contact portion of the first and second members in a state in which the first member and the second member are held.

2. The method of producing the composite as claimed in claim 1, wherein:

each of the N nails has a first portion formed so as to contact the first member in the moving step, a second portion formed so as to contact the second member in the moving step and a third portion formed so as to contact the first holder in the moving step, and in the moving step, by separating the second holder from the second member, the N nails are brought even closer to each other, and the first member is moved relative to the first holder in the direction crossing the first direction and a relative position of the first holder and the first member is adjusted.

3. The method of producing the composite as claimed in claim 1, wherein:

in the contacting step, a sandwiching force by the first holder and the second holder is set to be greater than the force that brings the N nails of the chucks closer to each other.

4. The method of producing the composite as claimed in claim 1, wherein:

the number of the nails is three or greater.

5. The method of producing the composite as claimed in claim 1, wherein:

each of the N nails has one or more holding portions including a portion formed so as to contact the first member and a portion formed so as to contact the second member in the moving step, in the moving step, a plurality of holding portions of the N nails are arranged at separate positions so as to surround the contact portion of the first and second members, and the total number of the plurality of holding portions of the N nails is three or greater.

6. A method of producing an ignition plug, the ignition plug having a tubular insulator having a penetration hole that extends in a direction of a center axis, a center electrode, at least a part of which is inserted into a top end side of the penetration hole, a tubular metal shell secured to an outer peripheral side of the insulator and a ground electrode connected to the metal shell, and at least one of the center electrode and the ground electrode being provided with a composite having a first member and a second member joined to the first member, the method comprising:

producing the composite using the method of claim 1; and producing the ignition plug using the produced composite.

7. A method of producing an ignition plug, the ignition plug having a tubular insulator having a penetration hole that extends in a direction of a center axis, a center electrode, at least a part of which is inserted into a top end side of the penetration hole, a tubular metal shell secured to an outer peripheral side of the insulator and a ground electrode connected to the metal shell, and at least one of the center electrode and the ground electrode being provided with a composite having a first member and a second member joined to the first member, the method comprising:

producing the composite using the method of claim 2; and producing the ignition plug using the produced composite.

8. A method of producing an ignition plug, the ignition plug having a tubular insulator having a penetration hole that extends in a direction of a center axis, a center electrode, at least a part of which is inserted into a top end side of the penetration hole, a tubular metal shell secured to an outer peripheral side of the insulator and a ground electrode connected to the metal shell, and at least one of the center electrode and the ground electrode being provided with a composite having a first member and a second member joined to the first member, the method comprising:

producing the composite using the method of claim 3; and producing the ignition plug using the produced composite.

9. A method of producing an ignition plug, the ignition plug having a tubular insulator having a penetration hole that extends in a direction of a center axis, a center electrode, at least a part of which is inserted into a top end side of the penetration hole, a tubular metal shell secured to an outer peripheral side of the insulator and a ground electrode connected to the metal shell, and at least one of the center electrode and the ground electrode being provided with a composite having a first member and a second member joined to the first member, the method comprising:

producing the composite using the method of claim 4; and producing the ignition plug using the produced composite.

10. A method of producing an ignition plug, the ignition plug having a tubular insulator having a penetration hole that extends in a direction of a center axis, a center electrode, at least a part of which is inserted into a top end side of the penetration hole, a tubular metal shell secured to an outer peripheral side of the insulator and a ground electrode connected to the metal shell, and at least one of the center electrode and the ground electrode being provided with a composite having a first member and a second member joined to the first member, the method comprising:

producing the composite using the method of claim 5; and producing the ignition plug using the produced composite.

* * * * *